United States Patent [19]

Meiller

[11] 4,364,605

[45] Dec. 21, 1982

[54] SEAT WITH A SEAT PLATE OF ADJUSTABLE INCLINATION AND A BACKREST OF ADJUSTABLE INCLINATION

[75] Inventor: Hermann Meiller, Amberg, Fed. Rep. of Germany

[73] Assignee: Willibald Grammer, Amberg, Fed. Rep. of Germany

[21] Appl. No.: 162,762

[22] Filed: Jun. 25, 1980

[30] Foreign Application Priority Data

Jul. 20, 1979 [DE] Fed. Rep. of Germany ..... 2929428

[51] Int. Cl.[3] ..... A47C 3/00; B60N 1/02

[52] U.S. Cl. ..... 297/306; 297/300; 297/304; 297/337; 297/354

[58] Field of Search ..... 297/345, 306, 313, 337, 297/354, 355, 300, 304; 74/471 R, 471; 137/636.1; 248/631

[56] References Cited

U.S. PATENT DOCUMENTS

| | | | |
|---|---|---|---|
| 2,265,260 | 12/1941 | Argo | 137/636.1 |
| 2,274,917 | 3/1942 | Carlson et al. | 137/636.1 |
| 2,831,502 | 4/1958 | Osborn | 137/636.1 |
| 3,741,511 | 6/1973 | Stretter | 248/631 |
| 3,880,465 | 4/1975 | Scheben | 248/631 |
| 4,200,332 | 4/1980 | Braüning | 297/300 |

FOREIGN PATENT DOCUMENTS

| | | | |
|---|---|---|---|
| 2757349 | 7/1979 | Fed. Rep. of Germany | 297/300 |

*Primary Examiner*—James T. McCall

*Attorney, Agent, or Firm*—Louis E. Marn; Elliot M. Olstein

[57] ABSTRACT

In a seat having a seat plate of adjustable inclination and a backrest of adjustable inclination, gas springs are provided for adjusting the inclination of the seat plate and backrest, the valve actuating pins of the gas springs being oppositely disposed and actuatable by an adjusting lever. The adjusting lever extends transversely to the valve actuating pin arrangement and is mounted to pivot vertically and horizontally about a common pivot point disposed beyond the straight connecting line between the valve actuating pins. In the preferred embodiment, two control arms on the seat carrier are movable in a scissor-like manner in a vertical plane containing the valve pin arrangement, the adjusting lever engaging between and co-operating with the control arms which co-operate with the valve actuating pins. This permits the inclination of the seat plate and the inclination of the backrest to be adjusted with a single operating element either at independent times or simultaneously.

10 Claims, 4 Drawing Figures

SEAT WITH A SEAT PLATE OF ADJUSTABLE INCLINATION AND A BACKREST OF ADJUSTABLE INCLINATION

The invention relates to a seat, particularly an office chair, comprising a seat plate of adjustable inclination mounted on a seat carrier and a backrest of adjustable inclination.

In known seats of this kind, separate operating elements are provided to adjust the inclination of the backrest and to adjust the inclination of the seat plate. The invention aims to provide a seat of the aforementioned kind in which the inclination of the seat plate and the inclination of the backrest can be adjusted with a single operating element either at independent times or simultaneously.

According to the invention, this object is achieved in that a first gas spring acts between the seat plate and seat carrier to adjust the inclination of the seat plate and a second gas spring acts between the seat carrier and backrest to adjust the backrest inclination, that the valve actuating pins of the gas springs are provided at the ends associated with the seat carrier and are oppositely disposed in V formation, and that a horizontal adjusting lever extending transversely to the valve actuating pin arrangement of V formation is mounted on the seat carrier to pivot vertically and horizontally about a common pivot point disposed beyond the straight connecting line between the valve actuating pins and has a wedge-shaped cam member engaging between the two valve actuating pins.

If in this arrangement the adjusting lever is pivoted horizontally towards the one valve actuating pin, this unlocks the one gas spring, for example the gas spring for the seat plate inclination, so that the seated person can adjust the inclination of the seat plate by shifting the force exerted by the thighs, whilst the other gas spring remains unactuated and therefore locked so that in this example the inclination of the backrest unaltered. Conversely, the other gas spring can be released to adjust the backrest inclination without unlocking the one gas spring if the adjusting lever is pivoted in the opposite horizontal direction and depresses the associated valve actuating pin. If the adjusting lever is returned to the starting position mid-way between the two valve actuating pins, both gas springs are locked again and the seat plate and backrest remain in the position assumed before the associated gas springs were locked.

However, it is also possible to unlock both gas springs simultaneously by swinging the adjusting lever vertically upwardly out of its starting position so that the two oblique faces of the wedge-shaped cam member engage the valve actuating pins simultaneously and depress same to unlock both gas springs. The backrest and seat plate will then together and automatically adapt themselves to any position of the body. When the adjusting lever is released, so that it returns to its starting position, the adjusted inclinations of the seat plate and backrest are maintained.

It will be evident that it is not essential resiliently to bias the adjusting lever so as to return to its starting position automatically because the necessary return forces are exerted by the valve actuating pins.

In a second and alternative construction, the wedge-shaped cam member is replaced by two control arms on the seat carrier movable in a scissor-like manner in a vertical plane containing the valve pin arrangement, the adjusting lever engaging between the control arms of which the outsides co-operate with the valve actuating pins. Thus, in this case the function of the cam member engaging in the manner of a wedge between the two valve actuating pins during vertical pivoting of the adjusting lever is instead performed by the two control arms which are spread apart during vertical pivoting of the adjusting lever and in this way act simultaneously on the valve actuating pins. During horizontal pivoting of the adjusting lever, only one or the other control arm is moved and consequently only the one or other valve actuating pin is operated. In other respects, the same remarks apply to this embodiment as were made in conjunction with the previous embodiment.

In both forms of the invention, it may be possible to lock the adjusting lever in the limiting position of its vertical pivotal motion, i.e. in the position at which both valve actuating pins are engaged. Since in this case the gas springs are permanently unlocked and can therefore yield or adapt themselves depending on how the position of the body is changed, one obtains a dynamic seat position.

Desirably, a slotted member is provided for guiding the adjusting lever. This may be of plate form and comprise a horizontal first guide slot parallel to the valve actuating pin arrangement and at the level of the basic position of the adjusting lever in which the valve actuating pins are not operated and, extending from the horizontal guide slot, a second guide slot extending vertically centrally of the valve actuating pin arrangement. To lock the adjusting lever in the upper vertical limiting position of pivotal movement for the dynamic seating position, the slotted member may be of resilient material, preferably plastics material, and the vertical guide slot may comprise a constriction at the end remote from the horizontal guide slot, incisions extending away from the verical guide slot to both sides of the constriction. The incisions, which must have a certain width to provide the necessary play, have the purpose of making the constricted zone flexible. It will be evident that the lugs defined by the constriction are so flexible that they can be deflected by increasing the force applied by the adjusting lever extending through the guide slot, whereby the adjusting lever can be passed up to the end of the guide slot where it is then locked by flexing back of the constriction.

It is of particular constructional advantage if the pivot point of the pivotable adjusting lever is disposed at the one end of the adjusting lever and the slotted member through which the adjusting lever passes is provided at that side of the valve actuating pin arrangement opposite to the pivot point.

The second embodiment of the invention attains particular importance for example in the case of an office chair having a single centrally arranged supporting leg. The adjusting lever is in this case made of ring shape in the region of the scissor-like arrangement of control arms and the scissor-like control arms are hinged at two spaced pivot points so that the supporting leg can pass through the ring of the adjusing lever and between the pivot points of the control arms.

In a further special embodiment of the invention, the carrier for the backrest extends below the seat plate and is there centrally connected to the seat carrier to pivot about a horizontal pivotal axis about which the seat plate can also swing, the first gas spring being pivoted to the front edge of the seat plate and the seat carrier and the second gas spring being pivoted to the seat carrier and the back rest carrier in the rear zone disposed beneath the seat plate. The gas springs therefore assume a V-shaped position.

The aforementioned explanations did not exclude the possibility of the pivot point for the scissors being disposed beneath the valve actuating pins, in which case the adjusting lever would have to be moved downwardly for simultaneous operation of both valve actuating pins. However, in practice, the pivot point of the control arms acting as scissors is placed above the valve actuating pins so that the adjusting lever has to be swung vertically upwardly for simultaneous operation of both valve actuating pins. Incidentally, the same also applies when using a wedge-shaped cam member instead of the control arms.

Finally, it is within the scope of the invention if, based on the first embodiment, the wedge is operative horizontally instead of in a vertical direction. The same applies to the scissors which can just as well open in a horizontal plane instead of the vertical plane. However, in both cases the adjusting lever would then have to be displaceable in its horizontal longitudinal direction but the horizontal pivotability remains the same. Although these embodiments are structurally much more expensive, it is nevertheless possible to use them to achieve the same effects. Further advantages, details and features of the invention will become evident from the following description of a preferred example with reference to the accompanying drawings, wherein:

Figure 1:
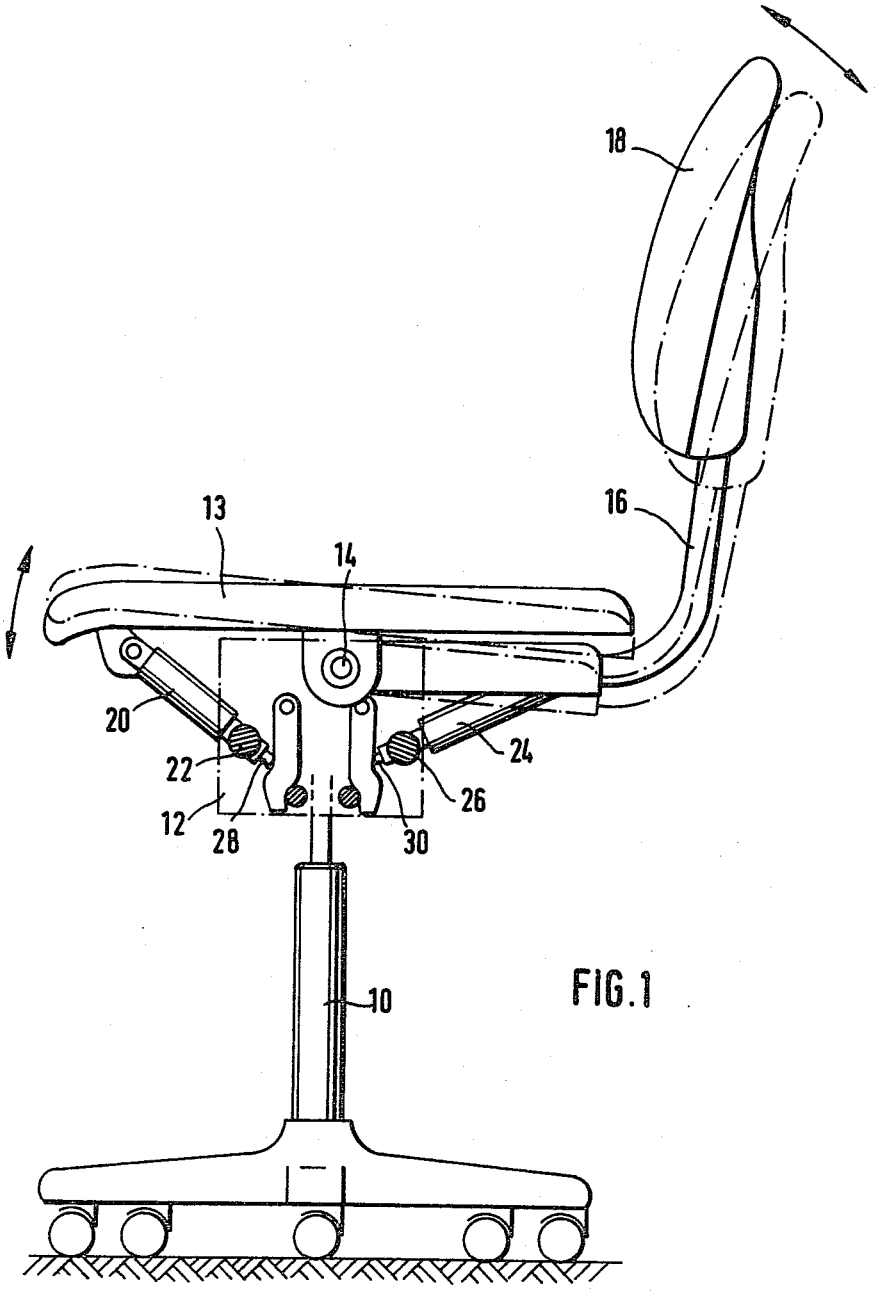
FIG. 1 is a part-sectional side elevation of an office chair according to the invention.

The office chair shown in the drawings comprises a post 10 which projects into a seat carrier 12 and is connected thereto in a manner not shown in detail, the carrier being only diagrammatically indicated in broken lines. A seat plate 13 is pivotably mounted about a horizontal pivot pin 14 on the seat carrier 12 and considerably above the post 10. An L-shaped backrest carrier 16 is, as is shown in FIG. 1, also pivotable about the same pivot pin 14 and carries the backrest 18 at its upwardly extending limb. The arrangement can in a conventional manner be such that the seat carrier 12 is rotatable about the post 10 together with the seat plate 13 and backrest 18.

A first gas spring 20 is hinged with its cylinder end to the underside of the seat plate 13 at the front thereof and has its piston end pivoted to the seat carrier 12 about a pin 22. A second gas spring 24 engages the backrest carrier 16 with its cylinder end whilst its piston end is pivoted to the seat carrier 12 about a pin 26. As will be evident from FIG. 1, the gas springs 20, 24 are arranged in V formation relatively to each other.

At their piston ends, each gas spring 20, 24 comprises a valve actuating pin 28, 30 as shown in FIG. 1. The pin is displaceable in the longitudinal direction of the respective gas spring and, when not being operated, projects beyond the piston ends which extend beyond the pins 22 and 26. If the valve actuating pins 28, 30 are operated, i.e. depressed into the piston ends, the gas springs 20 and 24 are unlocked so that they can expand and adjust the inclination of the seat plate 13 or backrest 18. However, if a counterpressure is exerted to exceed the gas spring pressure, the gas springs 20, 24 will become shorter and the seat plate and backrest will incline in the opposite direction. If the valve actuating pins 28, 30 are not being operated and the gas springs are therefore locked, their length is unalterable so that the inclination of the seat plate 13 and backrest 18 also remains unchanged irrespective of the load that may be applied.

Figure 2:
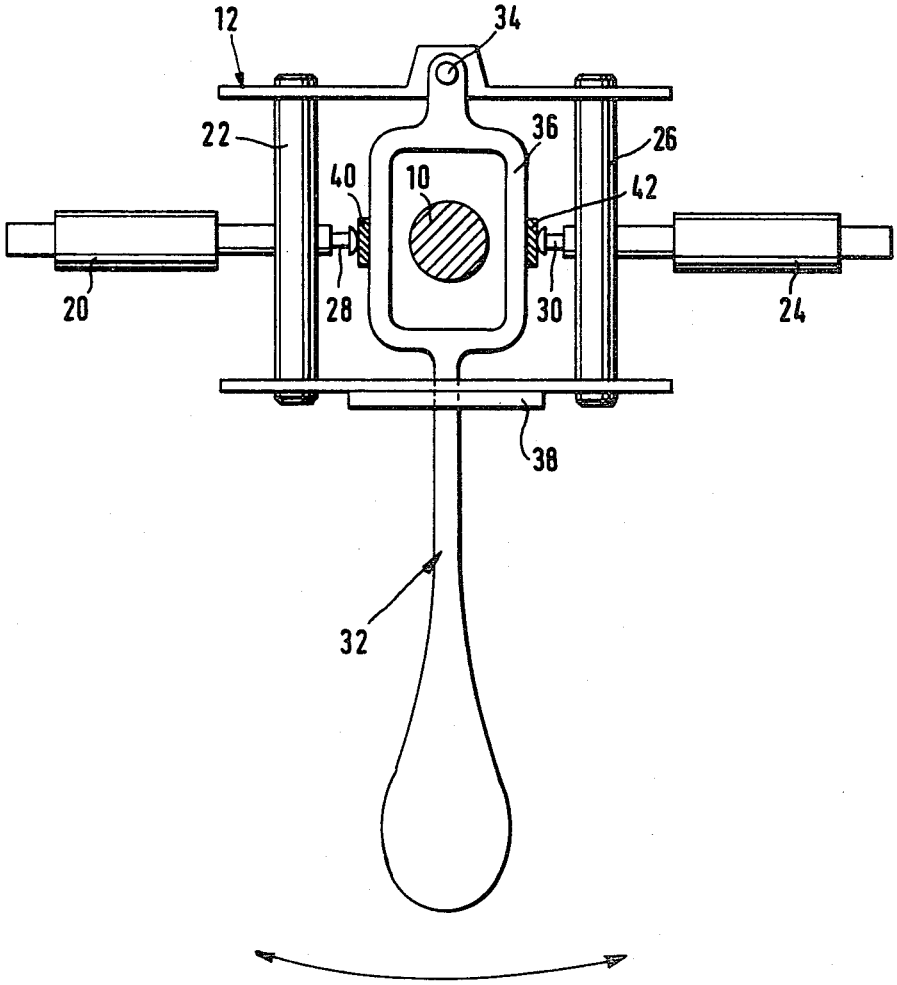
FIG. 2 is a plan view of the mechanism for actuating the gas springs.

As shown in FIG. 2, an adjusting lever 32 is vertically and horizontally pivotably mounted about a pivot point 34 on the seat carrier 12. The adjusting lever 32 extends substantially horizontally transversely to the V-shaped arrangement of the gas springs 20, 24 and, in the zone between the valve actuating pins 28, 30, as in the form of a rectangular ring 36 through which the post 10 passes. At the side of the seat carrier 12 opposite the pivot point 34, there is, as is illustrated, a slotted member 38 which is provided to guide the adjusting lever 32 and which will be described in more detail hereinafter.

Figure 3:
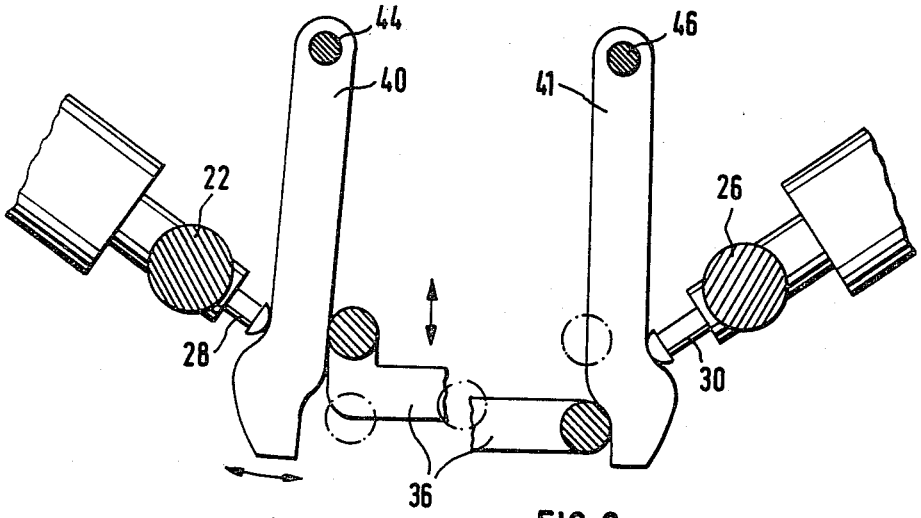
FIG. 3 is a side elevation of the important parts of the FIG. 2 mechanism.

As will be evident particularly from FIG. 3, provision is also made for two control or cam arms 40, 41 which are pivotable on the seat carrier 12 about horizontal shafts 44, 46 extending transversely to the V-shaped gas spring arrangement. The shafts 44, 46 are disposed above the pivot point 34 of the adjusting lever 33 and the control arms 40, 42 extend substantially vertically downwardly, the control arm 40 engaging between the valve actuating pin 28 and the ring 36 and the control arm 42 engaging between the ring 36 and the valve actuating pin 30. The outwardly disposed control cams co-operate with the valve actuating pins whereas the inwardly disposed control cams of the control arms co-operate with the ring 36 of the adjusting lever 32. As will be seen from FIG. 3, the control arms 40, 42 are spread apart upon vertical lifting of the ring 36 so that the control arms act on the valve actuating pins 28 and 30 of the gas springs 20, 24, whereby the gas springs are unlocked. Upon horizontal movement of the ring 36, either the one or the other of the control arms 40 and 42 is deflected, depending on the direction in which the adjusting lever 32 is swung, so that only the one or the other value actuating pin 28 or 30 is operated whereas the respective other pin has no force exerted on it. In this connection it is pointed out that the lower ends of the control arms 40, 42 are in each case offset or cranked outwardly as shown in FIG. 3 so that the ring 36 when located in a central position between the lower ends of the control arms 40, 42 engages neither the one nor the other control arm and thus neither of the valve actuating pins 28, 30 is operated by its control arm.

Figure 4:
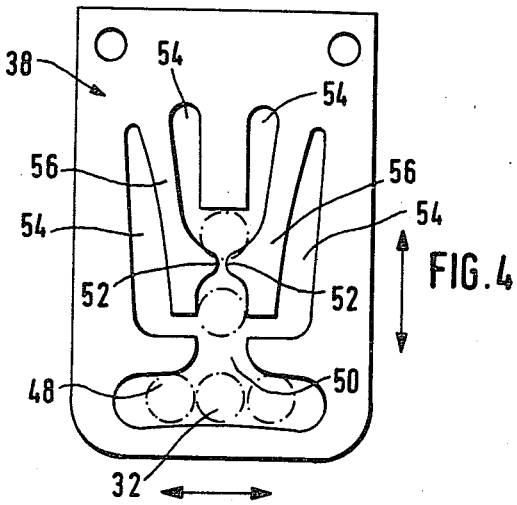
FIG. 4 shows a slotted member for guiding the adjusting lever.

The adjusting lever 32 extends through the slotted member 38 which is substantially plate-shaped and, as shown in FIG. 4, provided with a special aperture which will now be described. The aperture firstly comprises a horizontal guide slot 48 for the horizontal motion of the adjusting lever 32, namely in that zone where the ring 36 of the adjusting lever is disposed between the outwardly offset ends of the control arms 44 and 46. Extending centrally and vertically upwardly from this horizontal guide slot 48 there is a further guide slot 50 which has a construction 52 near its upper end. In front of and behind the constriction 52 and laterally of the guide slot 50 there are upwardly kinked incisions 54 which have a certain width. Lugs 56 are defined between the respective incisions 54 and these lugs carry the projections defining the constrictions 52. Since the slotted member 38 consists of a resilient plastics material, the aforementioned construction achieves the following effect. If the adjusting lever 32 is moved upwardly in the vertical guide slot 50 starting from the horizontal guide slot 32, the hand of the operator will feel a counterforce when the adjusting lever abuts the constriction 52. At least at this position, if not earlier, a force is also exerted on the two valve actuating pins 28 and 30 in the manner described above. If the adjusting lever 32 is then pushed further upwardly by exerting a higher force, the lugs 56 will be deflected laterally and the adjusting lever 32 engages behind the constriction 52 where it is retained by the lugs 56 which spring back to their original position. In this way the adjusting lever is locked in its upper limiting position of pivotal motion so that the valve actuating pins 28, 30 remain continuously operated. In this case the gas springs are therefore not locked and the inclination of the seat plate and backrest is continuously adapted in this dynamic seat position to the position of the body of the seated person. This dynamic seat position can of course be undone if the adjusting lever 32 is returned downwardly to its starting position against the force of the lugs 56.

Summarising, the present invention provides a three-day mechanism which is very simple and convenient to manipulate.

I claim:

1. A seat, particularly an office chair, comprising a seat plate of adjustable inclination arranged on a seat carrier, and a backrest of adjustable inclination, characterised in that a first gas spring acts between the seat plate and seat carrier to adjust the inclination of the seat plate and a second spring acts between the seat carrier and backrest to adjust the backrest inclination, that the valve actuating pins of the gas springs are provided at the ends associated with the seat carrier and are oppositely disposed, preferably in V formation, and that a horizontal adjusting lever extending transversely to the valve actuating pin arrangement is mounted on the seat carrier to pivot vertically and horizontally about a common pivot point disposed beyond the straight connecting line between the valve actuating pins, and that two control arms on the seat carrier are movable in a scissor-like manner in a vertical plane containing the valve pin arrangement, the adjusting lever engaging between and co-operating with the control arms which co-operate with the valve actuating pins.

2. A seat according to claim 1, characterized in that the adjusting lever can be locked in its limiting position of vertical pivotal motion.

3. A seat according to claim 1 or 2, characterized in that a slotted member is provided for guiding the adjusting lever.

4. A seat according to claim 3, characterized in that the slotted member comprises a horizontal guide slot parallel to the valve actuating pin arrangement at the level of the basic position of the adjusting lever in which no force is exerted on the valve actuating pins and, extending from the horizontal guide slot, a vertical second guide slot extending centrally to the valve actuating pin arrangement.

5. A seat according to claim 4, characterized in that the plate-shaped slotted member is of a resilient material, preferably plastics material, and that the end portion of the vertical guide slot remote from the horizontal guide slot comprises a constriction, incisions extending away from the vertical guide slot to both sides to form lugs which carry the constrictions.

6. A seat according to claims 2, 4 or 5 characterised in that the pivot point of the pivotable adjusting lever is disposed at the one end of the adjusting lever and that the slotted member through which the adjusting lever passes is provided at the side of the valve actuating pin arrangement remote from the pivot point.

7. A seat according to claim 1, 2, 4 or 5, comprising a single centrally arranged supporting leg, characterized in that the adjusting lever is in the form of a ring in the zone of the scissor-like arrangement of control arms, that the control arms arranged in scisssor-like manner are hinged to two spaced pivot shafts, and that the supporting leg extends through the ring of the adjusting lever and between the pivot shafts of the control arms.

8. A seat according to claim 1, 2, 4 or 5 characterized in that the backrest carrier extends below the seat plate and is there pivotable in a central zone of the seat carrier about a pivot shaft about which the seat plate is also pivotable, and that the first gas spring is hinged to the front edge of the seat plate and to the seat carrier and the second gas spring is hinged to the seat carrier and to the backrest carrier in the rear zone disposed beneath the seat plate.

9. A seat according to claim 1, 2, 4, or 5, characterized in that the pivot shafts of the control arms are disposed above the valve actuating pins.

10. A seat, particularly an office chair, comprising a seat plate of adjustable inclination arranged on a seat carrier, and a backrest of adjustable inclination, characterized in that a first gas spring acts between the seat plate and seat carrier to adjust the inclination of the seat plate and a second gas spring acts between the seat carrier and backrest to adjust the backrest inclination, that the valve actuating pins of the gas springs are provided at the ends associated with the seat carrier and are oppositely disposed, that a horizontal adjusting lever extending transversely to the valve actuating pin arrangement is mounted on the seat carrier for pivoting in a horizontal direction and displacement in the longitudinal direction and that two control arms on the seat carrier are movable in a scissor-like manner in a horizontal plane containing the valve actuating pins, the adjusting lever engaging between and co-operating with the control arms, the outsides of which co-operate with the valve actuating pins.

* * * * *